US009295874B1

(12) United States Patent
Chen

(10) Patent No.: US 9,295,874 B1
(45) Date of Patent: Mar. 29, 2016

(54) ELLIPTICAL TRAINER

(71) Applicant: Yi-Tzu Chen, Bade (TW)
(72) Inventor: Yi-Tzu Chen, Bade (TW)

( * ) Notice: Subject to any disclaimer, the term of this patent is extended or adjusted under 35 U.S.C. 154(b) by 0 days.
(21) Appl. No.: 14/551,700
(22) Filed: Nov. 24, 2014
(51) Int. Cl.
*A63B 22/04* (2006.01)
*A63B 22/00* (2006.01)
*A63B 69/18* (2006.01)
*A63B 22/06* (2006.01)
*A63B 21/015* (2006.01)
(52) U.S. Cl.
CPC ..... *A63B 22/0664* (2013.01); *A63B 21/015* (2013.01); *A63B 2022/0676* (2013.01)
(58) Field of Classification Search
CPC ..... A63B 21/00; A63B 21/015; A63B 22/00; A63B 22/06; A63B 22/0664; A63B 22/0694; A63B 2022/0676; A63B 2022/067; A63B 2022/0682; A63B 71/00
USPC ..... 482/51–53, 57–65, 70
See application file for complete search history.

(56) References Cited

U.S. PATENT DOCUMENTS 5,207,622 A * 5/1993 Wilkinson ..... A63B 21/1609 482/118
5,792,027 A * 8/1998 Gvoich ..... A63B 22/001 482/51
6,045,488 A * 4/2000 Eschenbach ..... A63B 222/001 482/52
7,137,927 B2 * 11/2006 Maresh ..... A63B 22/0007 482/52
7,611,446 B2 * 11/2009 Chuang ..... A63B 22/0015 482/52
7,794,362 B2 * 9/2010 Miller ..... A63B 2/0017 482/52
7,833,133 B2 * 11/2010 Stewart ..... A63B 22/0017 482/52
8,105,213 B2 * 1/2012 Stewart ..... A63B 22/001 482/52
8,303,470 B2 * 11/2012 Stewart ..... A63B 22/001 482/51
9,017,225 B2 * 4/2015 Huang ..... A63B 22/0664 482/51
9,050,498 B2 * 6/2015 Lu ..... A63B 21/154
9,138,614 B2 * 9/2015 Lu ..... A63B 21/154
2004/0224825 A1 * 11/2004 Giannelli ..... A63B 21/225 482/52
2005/0202939 A1 * 9/2005 Lull ..... A63B 22/001 482/57
2006/0100065 A1 * 5/2006 Maresh ..... A63B 22/0007 482/52
2008/0161164 A1 * 7/2008 Stewart ..... A63B 22/001 482/52
2008/0261778 A1 * 10/2008 Chuang ..... A63B 22/001 482/52
2008/0287265 A1 * 11/2008 Giannelli ..... A63B 22/001 482/52
2008/0312050 A1 * 12/2008 Chuang ..... A63B 21/225 482/70
2009/0005222 A1 * 1/2009 Liao ..... A63B 22/001 482/52
2009/0105049 A1 * 4/2009 Miller ..... A63B 22/0017 482/52
2013/0053218 A1 * 2/2013 Barker ..... G06F 19/3481 482/4
2014/0051552 A1 * 2/2014 Habing ..... A63B 21/154 482/52
2014/0194256 A1 * 7/2014 Huang ..... A63B 22/0664 482/52
2015/0246260 A1 * 9/2015 Giannelli ..... A63B 21/4023 482/8

* cited by examiner

*Primary Examiner* — Loan H Thanh
*Assistant Examiner* — Garrett Atkinson
(74) *Attorney, Agent, or Firm* — C. G. Mersereau; Nikolai & Mersereau, P.A.

(57) ABSTRACT

An elliptical trainer has a base, two sliding assemblies, a slope adjusting mechanism, and two stride adjusting mechanisms. A transverse diameter of an elliptical path that a user exercises along can be adjusted by driving the slope adjusting mechanism, so as to adjust each stride of the user. A slope of the elliptical path can also be adjusted by driving the stride adjusting mechanisms, so as to provide climbing exercise effects. The elliptical trainer can be easily adjusted to form different exercise modes and intensities. The user's desire for exercising on the elliptical trainer can be increased accordingly.

16 Claims, 9 Drawing Sheets

ELLIPTICAL TRAINER

BACKGROUND OF THE INVENTION

1. Field of the Invention

The present invention relates to an elliptical trainer, especially to an elliptical trainer that can be adjusted such that a user can exercise along difference elliptical paths.

2. Description of the Prior Art(s)

An elliptical trainer is an indoor exercise equipment. When exercising on the elliptical trainer, a user holds rods of the elliptical trainer with his two hands and steps on footrests of the elliptical trainer with his two feet. Then the user drives the rods to alternately swing back and forth, and the feet of the user move back and forth and up and down along a substantially elliptical path, so as to simulate walking or running movements without causing excessive pressure to the knee joints and decreases the risk of impact injuries.

However, when people of different heights or leg lengths are walking or running, swing ranges of the hands and stride lengths of the feet are different. Since the rods and the footrests are mounted on specific positions of a conventional elliptical trainer, the elliptical path that the footrests move along is also specific. Therefore, the stride lengths cannot be adjusted according to the user's body shape or the user's need. Moreover, slope of the elliptical path also cannot be adjusted for forming different exercise intensities. Consequently, the user might feel bored over time, and lose their desire to keep on exercising on the conventional elliptical trainer.

To overcome the shortcomings, the present invention provides an elliptical trainer to mitigate or obviate the aforementioned problems.

SUMMARY OF THE INVENTION

The main objective of the present invention is to provide an elliptical trainer. The elliptical trainer has a base, two sliding assemblies, a slope adjusting mechanism, and two stride adjusting mechanisms. The base has a stationary stand, a supporting bracket pivotally mounted on the stationary stand, and a transmission wheel rotatably mounted on the supporting bracket. The sliding assemblies are separately mounted on the supporting bracket. The slope adjusting mechanism is mounted between the supporting bracket and the stationary stand. The stride adjusting mechanisms are respectively mounted on the sliding assemblies.

A transverse diameter of an elliptical path that a user exercises along can be adjusted by driving the slope adjusting mechanism, so as to adjust each stride of the user. A slope of the elliptical path can also be adjusted by driving the stride adjusting mechanisms, so as to provide climbing exercise effects. The elliptical trainer can be easily adjusted to form different exercise modes and intensities. The user's desire for exercising on the elliptical trainer can be increased accordingly.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
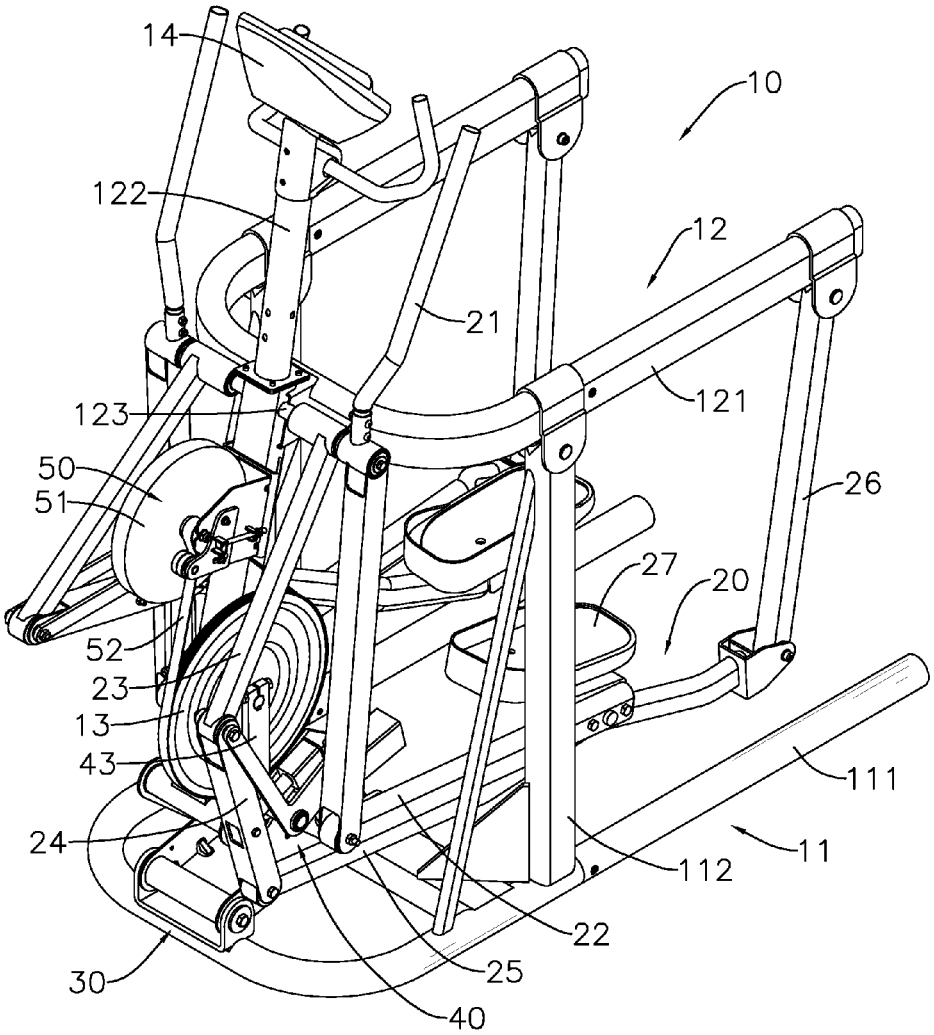
FIG. 1 is a perspective view of an elliptical trainer in accordance with the present invention.
Figure 2:
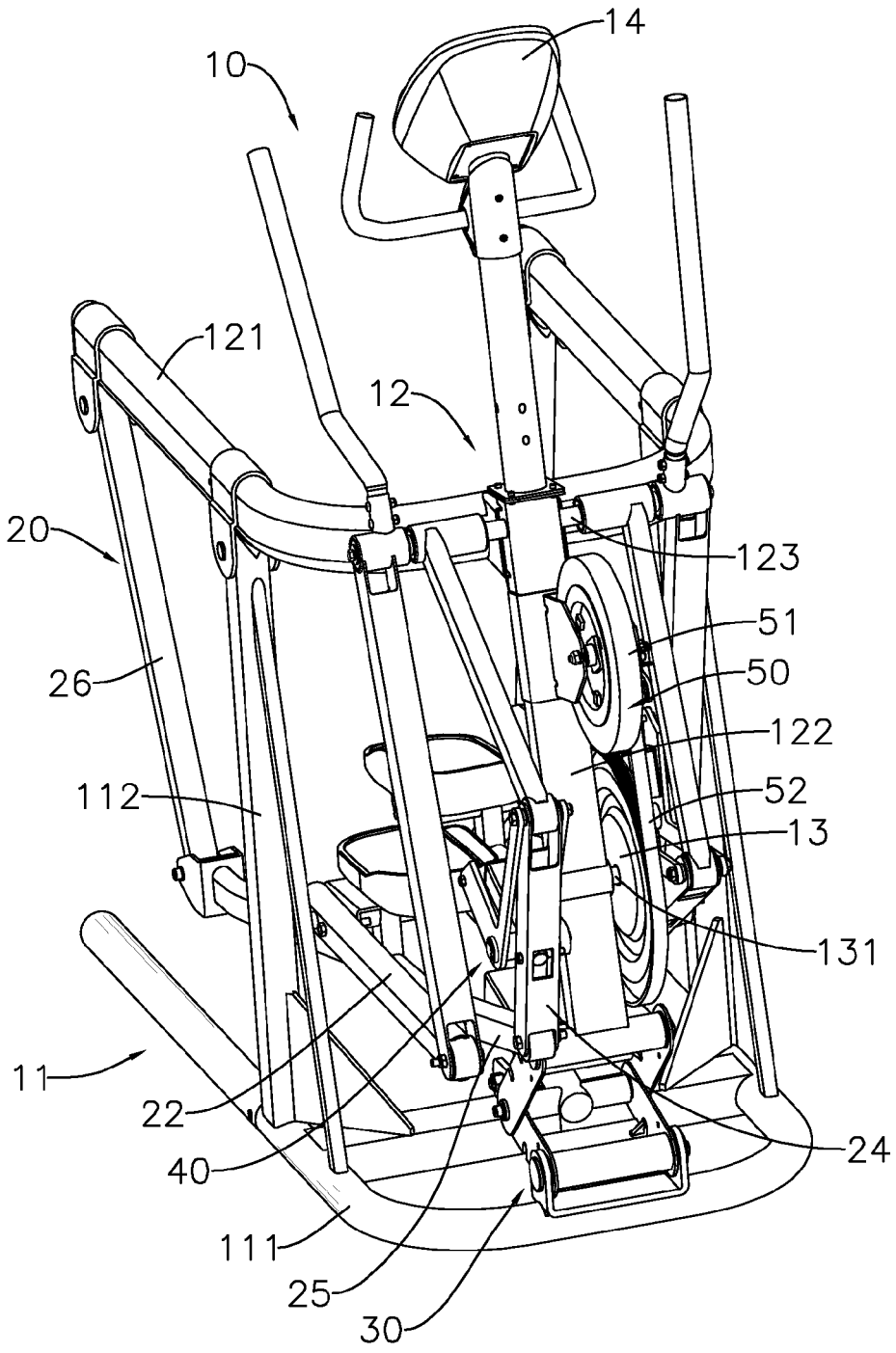
FIG. 2 is another perspective view of the elliptical trainer in FIG. 1.

With reference to FIGS. 1 and 2, an elliptical trainer in accordance with the present invention comprises a base 10, two sliding assemblies 20, a slope adjusting mechanism 30, two stride adjusting mechanisms 40, and a resistance mechanism 50.

The base 10 has a rear, a stationary stand 11, a supporting bracket 12, and a transmission wheel 13. The stationary stand 11 has a bottom frame 111 and two side rods 112. The bottom frame 111 has two opposite sides. The side rods 112 are respectively mounted longitudinally on the two sides of the bottom frame 111. Each of the side rods 112 has a top end. The supporting bracket 12 is pivotally mounted on the stationary stand 11 and has a front, a top frame 121, a front rod 122, and a transverse shaft 123. The top frame 121 is pivotally mounted on the top ends of the side rods 112 of the stationary stand 11 and is capable of pitching about an axis that passes through the top ends of the side rods 112. The top frame 121 has a front and a rear. The front rod 122 is mounted on the front of the top frame 121 and extends longitudinally. The front rod 122 has a lower end and an upper end. The transverse shaft 123 is transversely mounted through the front rod 122. The transmission wheel 13 is rotatably mounted on the front rod 122 of the supporting bracket 12 via a mounting shaft 131.

The sliding assemblies 20 are mounted on the supporting bracket 12 and are oppositely disposed beside the transmission wheel 13. Each of the sliding assemblies 20 has a holding rod 21, a front swing rod 23, a rear swing rod 26, and a footrest 27.

The holding rod 21 is elongated, is pivotally mounted on the transverse shaft 123, and has an upper portion and a lower portion. The upper portion of the holding rod 21 extends up from the transverse shaft 123 and is formed as a handle for a user to hold. The lower portion of the holding rod 21 extends down from the transverse shaft 123 and is pivotally connected with a first connecting rod 22. The first connecting rod 22 extends transversely toward the rear of the base 10.

The front swing rod 23 is pivotally mounted on and extends down from the transverse shaft 123 and has a lower end. The lower end of the front swing rod 23 is pivotally connected to an end of an adjusting rod 24. Another end of the adjusting rod 24 is pivotally connected with a second connecting rod 25. The second connecting rod 25 also extends transversely toward the rear of the base 10. The first connecting rod 22 is connected to the second connecting rod 25.

The rear swing rod 26 is pivotally mounted on the top frame 121, is disposed adjacent to the rear of the top frame 121, extends down from the top frame 121, and is pivotally connected to the second connecting rod 25. The footrest 27 is mounted on the first connecting rod 22.

Figure 3:
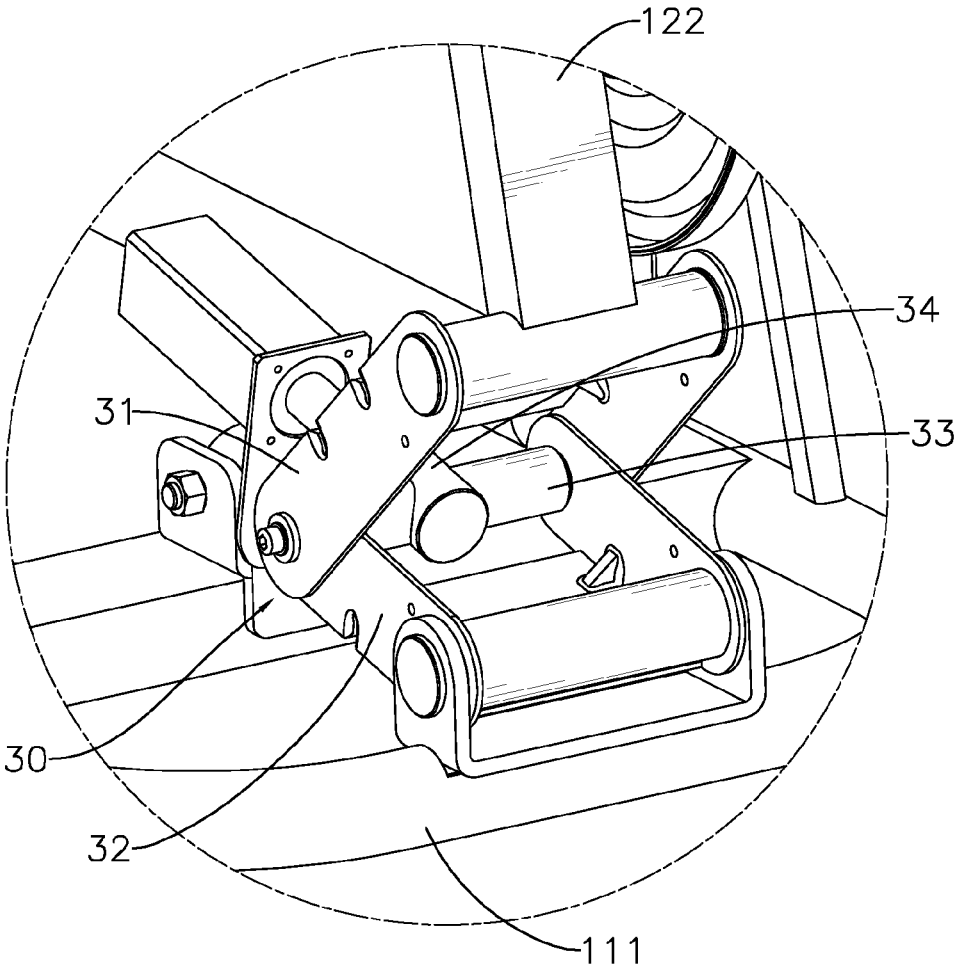
FIG. 3 is an enlarged perspective view of a slope adjusting mechanism of the elliptical trainer in FIG. 1.

With further reference to FIG. 3, the slope adjusting mechanism 30 is mounted between the lower end of the front rod 122 and the stationary stand 11 and is capable of adjusting a distance defined between the lower end of the frond rod 122 and the stationary stand 11. The slope adjusting mechanism 30 has an upper lifting bracket 31, a lower lifting bracket 32, and a slope telescopic arm 34. The upper lifting bracket 31 has a lower end and an upper end. The upper end of the upper lifting bracket 31 is pivotally connected to the lower end of the front rod 122. The lower lifting bracket 32 has a lower end and an upper end. The lower end of the lower lifting bracket 32 is pivotally mounted to the stationary stand 11. The upper end of the lower lifting bracket 32 is pivotally connected to the lower end of the upper lifting bracket 31 via a driven rod 33. The slope telescopic arm 34 is capable of being elongated or shortened and has two opposite ends. One of the ends of the slope telescopic arm 34 is securely connected to the stationary stand 11. The other end of the slope telescopic arm 34 is connected to the driven rod 33.

Figure 5:
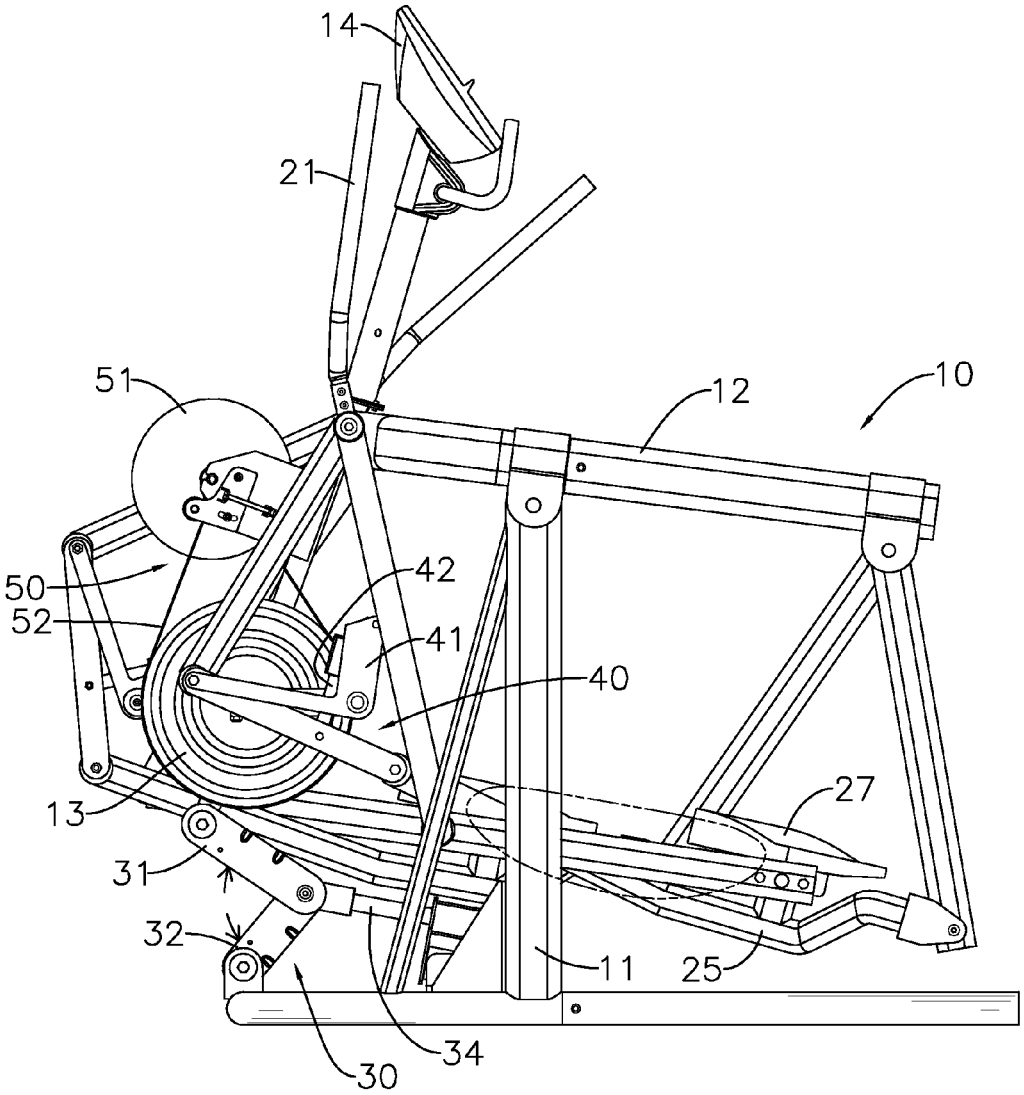
FIG. 5 is a side view of the elliptical trainer in FIG. 1, wherein a slope telescopic arm is elongated and a stride telescopic arm is shortened.
Figure 6:
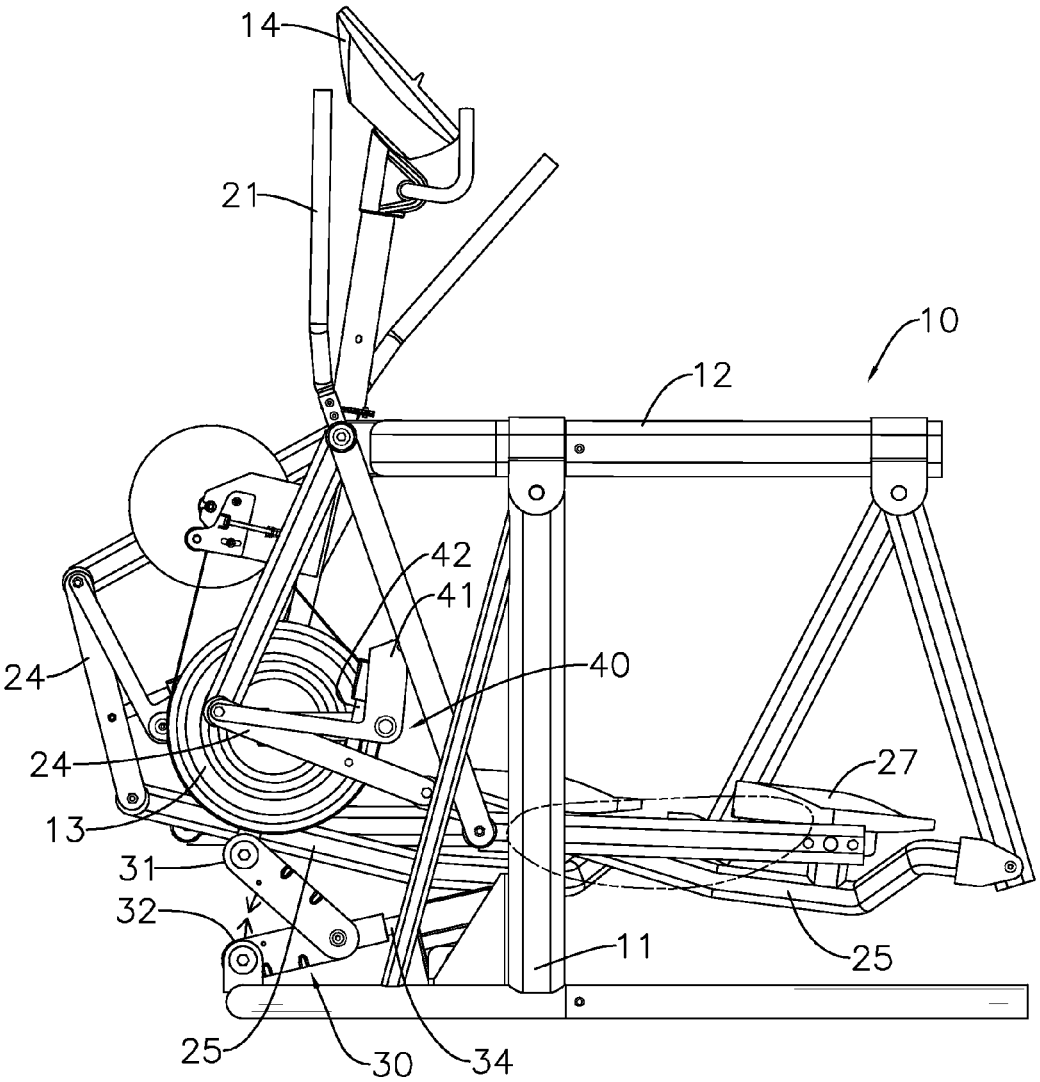
FIGS. 6 and 7 are operational side views of the elliptical trainer in FIG. 1, wherein the slope telescopic arm and the stride telescopic arm are shortened.

With further reference to FIGS. 5 and 6, when the slope telescopic arm 34 is elongated or shortened, a distance defined between the upper end of the upper lifting bracket 31 and the lower end of the lower lifting bracket 32 changes accordingly. Thus, the front rod 122 as well as the front of the supporting bracket 12 is lifted or lowered.

Figure 4:
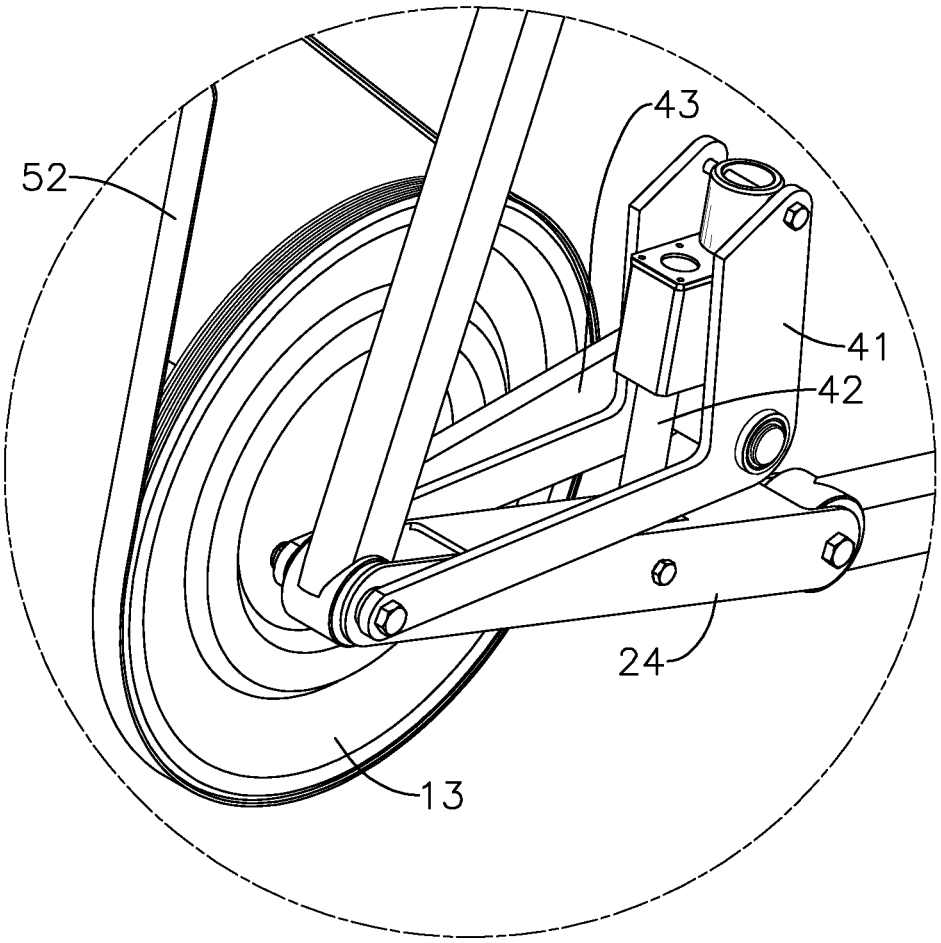
FIG. 4 is an enlarged perspective view of a stride adjusting mechanism of the elliptical trainer in FIG. 1.

With further reference to FIG. 4, the stride adjusting mechanisms 40 are respectively mounted on the adjusting rods 24 of the sliding assemblies 20. Each of the stride adjusting mechanisms 40 has an adjusting bracket 41, a stride telescopic arm 42, and a transmission crank 43. The adjusting bracket 41 has two ends. One of the ends of the adjusting bracket 41 is pivotally connected to a corresponding one of the adjusting rods 24. The stride telescopic arm 42 is capable of being elongated or shortened and has two opposite ends. One of the ends of the stride telescopic arm 42 is pivotally connected to the other end of the adjusting bracket 41. The other end of the stride telescopic arm 42 is pivotally connected to the corresponding one of the adjusting rods 24. The transmission crank 43 has two opposite ends. One of the ends of the transmission crank 43 is pivotally connected to the mounting shaft 131 of the transmission wheel 13. The other end of the transmission crank 43 is pivotally connected to the adjusting bracket 41 and is disposed between the two ends of the adjusting bracket 41. Furthermore, the transmission cranks 43 of the stride adjusting mechanisms 40 extend from the mounting shaft 131 of the transmission wheel 13 and toward opposite directions.

In the preferred embodiment, the adjusting bracket 41 is substantially V-shaped, and the slope telescopic arm 34 and the stride telescopic arm 42 are cylinders with variable lengths. A controller 14 is mounted on the upper end of the front rod 122 of the supporting bracket 12, and is electrically connected to and selectively elongates or shortens the slope telescopic arm 34 and the stride telescopic arm 42, such that lengths of the slope telescopic arm 34 and the stride telescopic arm 42 are adjusted in a stepless manner.

The resistance mechanism 50 is mounted on the front rod 122 of the supporting bracket 12 and has a resistance wheel 51 and a transmission belt 52. The resistance wheel 51 is rotatably mounted on the front rod 122 and has a side surface and an axial protrusion. The axial protrusion protrudes from the side surface of the resistance wheel 51, is disposed at a rotation axis of the resistance wheel 51, and corresponds in position to the transmission wheel 13. The transmission belt 52 is mounted on and around the axial protrusion of the resistance wheel 51 and the transmission wheel 13. A resistance device is mounted on and applies a rotating resistance to the resistance wheel 51, so as to hinder the resistance wheel 51 from rotating. The rotating resistance may be controlled and adjusted by a magnetic control unit. The magnetic control unit is conventional and thus description about the magnetic control unit is omitted. With the resistance mechanism 50 hindering the user's exercising, difficulty and intensity level of the exercise can be adjusted.

As shown in FIG. 5, when exercising on the elliptical trainer, the user holds the upper portions of the holding rods 21 with his two hands and steps on the footrests 27 with his two feet. The user drives the holding rods 21 to alternately swing back and forth, and the feet of the user move back and forth and up and down along a substantially elliptical path. When the slope telescopic arm 34 is elongated, the supporting bracket 12 is raised by the upper lifting bracket 31 and the lower lifting bracket 32. Accordingly, a front of the elliptical path tilts upward. As shown in FIG. 6, when the slope telescopic arm 34 is shortened, the supporting bracket 12 is lowered down by the upper lifting bracket 31 and the lower lifting bracket 32. Accordingly, the front of the elliptical path tilts downward, such that a slope of the elliptical path becomes gentle.

Figure 7:
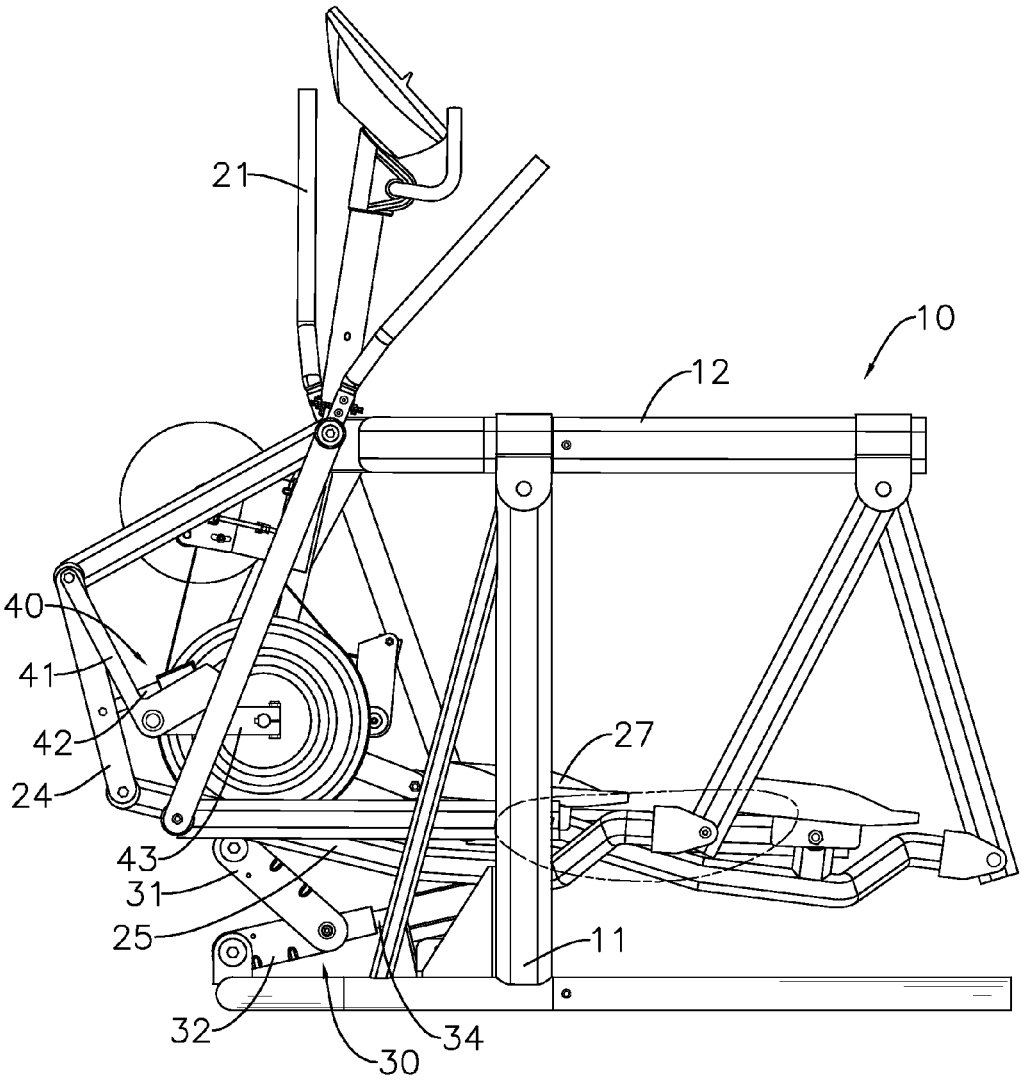

With reference to FIGS. 6 and 7, when the stride telescopic arm 42 is shortened, an included angle defined between the adjusting rod 24 and the adjusting bracket 41 is reduced and the adjusting rod 24 drives the second connecting rod 25 to pivot toward the rear of the base 10. Thus, a distance defined between a foremost position and a rearmost position of any one of the second connecting rod 25 and the footrests 27 is shortened. A transverse diameter of the elliptical path and each stride of the user are also shortened accordingly.

Figure 8:
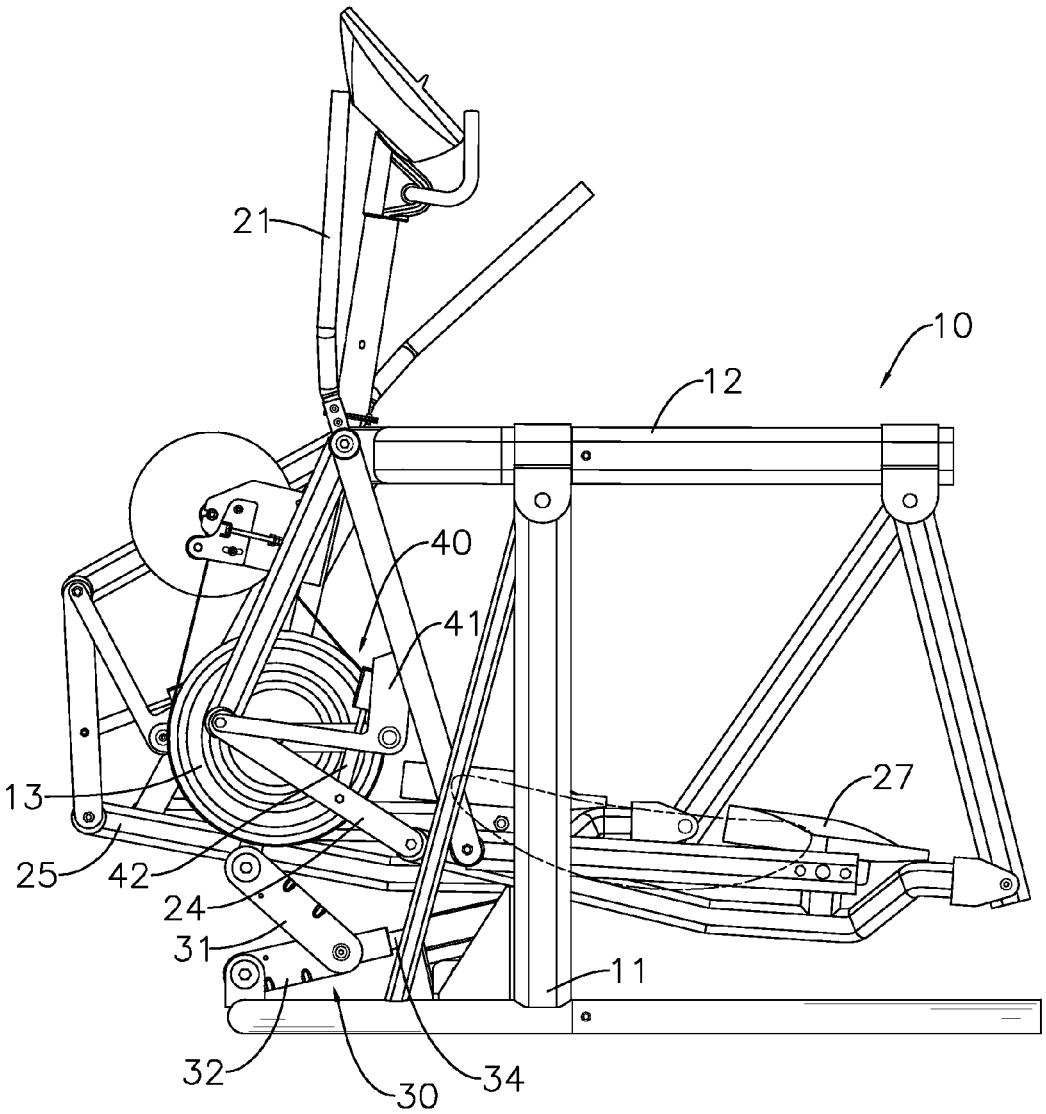
FIGS. 8 and 9 are operational side views of the elliptical trainer in FIG. 1, wherein the slope telescopic arm is shortened and the stride telescopic arm is elongated.
Figure 9:
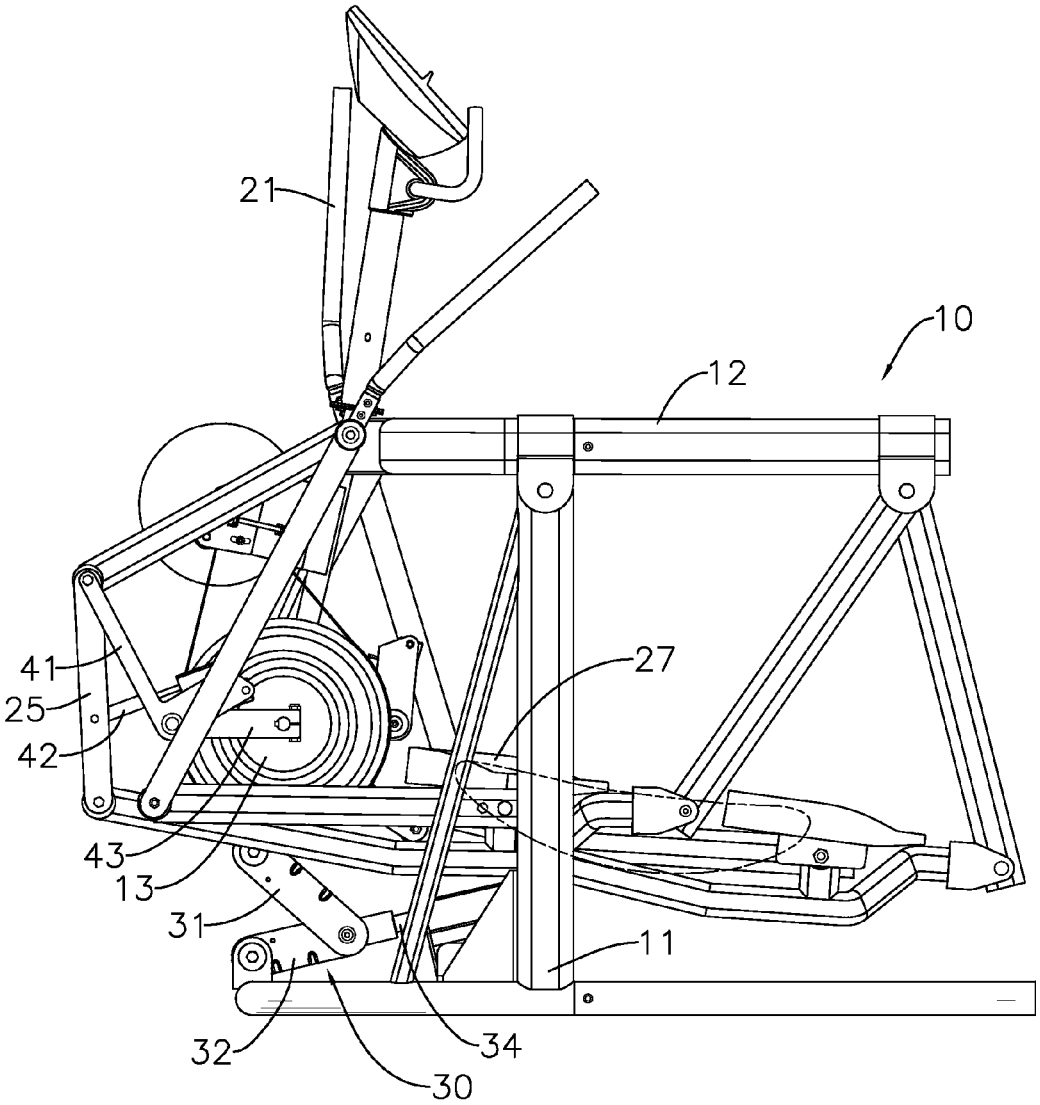

With reference to FIGS. 8 and 9, when the stride telescopic arm 42 is elongated, the included angle defined between the adjusting rod 24 and the adjusting bracket 41 is enlarged and the adjusting rod 24 drives the second connecting rod 25 to pivot toward a front of the base 10. Thus, the distance defined between the foremost position and the rearmost position of any one of the second connecting rod 25 and the footrests 27 is elongated. A transverse diameter of the elliptical path and each stride of the user are also elongated accordingly.

The elliptical trainer as described can be easily adjusted to form different exercise modes and intensities, so as to increases the user's desire for exercising on the elliptical trainer.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An elliptical trainer comprising:

a base having a stationary stand;

a supporting bracket having a top frame pivotally mounted on the stationary stand;

a front rod mounted on a front of the top frame and extending longitudinally; and a transverse shaft transversely mounted through the front rod; and a transmission wheel rotatably mounted on the front rod of the supporting bracket via a mounting shaft;

two sliding assemblies mounted on the supporting bracket and oppositely disposed beside the transmission wheel, each of the sliding assemblies having a holding rod pivotally mounted on the transverse shaft and having an upper portion extending up from the transverse shaft; and a lower portion extending down from the transverse shaft and pivotally connected with a first connecting rod, the first connecting rod extending transversely toward a rear of the base;

a front swing rod pivotally mounted on and extending down from the transverse shaft and having a lower end, the lower end of the front swing rod pivotally connected to an end of an adjusting rod, another end of the adjusting rod pivotally connected with a second connecting rod, the second connecting rod extending transversely toward the rear of the base and connected to the first connecting rod;

a rear swing rod pivotally mounted on the top frame, disposed adjacent to a rear of the top frame, extending down from the top frame, and pivotally connected to the second connecting rod; and a footrest mounted on the first connecting rod;

a slope adjusting mechanism mounted between a lower end of the front rod and the stationary stand and capable of adjusting a distance defined between the lower end of the frond rod and the stationary stand; and two stride adjusting mechanisms respectively mounted on the adjusting rods of the sliding assemblies, each of the stride adjusting mechanisms having an adjusting bracket having two ends, one of the ends of the adjusting bracket pivotally connected to a corresponding one of the adjusting rods;

a stride telescopic arm having two opposite ends pivotally connected to the other end of the adjusting bracket and the corresponding one of the adjusting rods respectively; and a transmission crank having two opposite ends, one of the ends of the transmission crank pivotally connected to the mounting shaft of the transmission wheel, the other end of the transmission crank pivotally connected to the adjusting bracket and disposed between the two ends of the adjusting bracket, the transmission cranks of the stride adjusting mechanisms extending from the mounting shaft of the transmission wheel and toward opposite directions.

2. The elliptical trainer as claimed in claim 1, wherein the slope adjusting mechanism has an upper lifting bracket having a lower end; and an upper end pivotally connected to the lower end of the front rod;

a lower lifting bracket having a lower end pivotally mounted to the stationary stand; and an upper end pivotally connected to the lower end of the upper lifting bracket via a driven rod; and a slope telescopic arm having two opposite ends connected to the stationary stand and the driven rod respectively.

3. The elliptical trainer as claimed in claim 2 further comprising a resistance mechanism mounted on the front rod of the supporting bracket and having a resistance wheel rotatably mounted on the front rod and having an axial protrusion, the axial protrusion protruding from a side surface of the resistance wheel and corresponding in position to the transmission wheel; and a transmission belt mounted on and around the axial protrusion of the resistance wheel and the transmission wheel.

4. The elliptical trainer as claimed in claim 3, wherein the stationary stand of the base has a bottom frame; and two side rods respectively mounted longitudinally on two opposite sides of the bottom frame, each of the side rods having a top end; and the top frame of the supporting bracket is pivotally mounted on the top ends of the side rods.

5. The elliptical trainer as claimed in claim 3, wherein the adjusting bracket of each of the stride adjusting mechanisms is V-shaped.

6. The elliptical trainer as claimed in claim 3, wherein the slope telescopic arm and the stride telescopic arm are cylinders with variable lengths.

7. The elliptical trainer as claimed in claim 3, wherein a controller is mounted on an upper end of the front rod of the supporting bracket, and is electrically connected to and selectively elongates or shortens the slope telescopic arm and the stride telescopic arm.

8. The elliptical trainer as claimed in claim 2, wherein the stationary stand of the base has a bottom frame; and two side rods respectively mounted longitudinally on two opposite sides of the bottom frame, each of the side rods having a top end; and the top frame of the supporting bracket is pivotally mounted on the top ends of the side rods.

9. The elliptical trainer as claimed in claim 2, wherein the adjusting bracket of each of the stride adjusting mechanisms is V-shaped.

10. The elliptical trainer as claimed in claim 2, wherein the slope telescopic arm and the stride telescopic arm are cylinders with variable lengths.

11. The elliptical trainer as claimed in claim 2, wherein a controller is mounted on an upper end of the front rod of the supporting bracket, and is electrically connected to and selectively elongates or shortens the slope telescopic arm and the stride telescopic arm.

12. The elliptical trainer as claimed in claim 1 further comprising a resistance mechanism mounted on the front rod of the supporting bracket and having a resistance wheel rotatably mounted on the front rod and having an axial protrusion, the axial protrusion protruding from a side surface of the resistance wheel and corresponding in position to the transmission wheel; and a transmission belt mounted on and around the axial protrusion of the resistance wheel and the transmission wheel.

13. The elliptical trainer as claimed in claim 12, wherein the stationary stand of the base has a bottom frame; and two side rods respectively mounted longitudinally on two opposite sides of the bottom frame, each of the side rods having a top end; and the top frame of the supporting bracket is pivotally mounted on the top ends of the side rods.

14. The elliptical trainer as claimed in claim 12, wherein the adjusting bracket of each of the stride adjusting mechanisms is V-shaped.

15. The elliptical trainer as claimed in claim 1, wherein the stationary stand of the base has a bottom frame; and two side rods respectively mounted longitudinally on two opposite sides of the bottom frame, each of the side rods having a top end; and the top frame of the supporting bracket is pivotally mounted on the top ends of the side rods.

16. The elliptical trainer as claimed in claim 1, wherein the adjusting bracket of each of the stride adjusting mechanisms is V-shaped.

* * * * *